US005795045A

United States Patent [19]

Lee

[11] Patent Number: 5,795,045

[45] Date of Patent: Aug. 18, 1998

[54] REFRIGERATOR HAVING A SWING SHELF

[75] Inventor: Sang-Moo Lee, Incheon, Rep. of Korea

[73] Assignee: Daewoo Electronics Co., Ltd., Seoul, Rep. of Korea

[21] Appl. No.: 692,191

[22] Filed: Aug. 5, 1996

[30] Foreign Application Priority Data

Aug. 4, 1995 [KR] Rep. of Korea ..... 1995-24188

[51] Int. Cl.[6] ..... A47B 96/06

[52] U.S. Cl. ..... 312/408; 211/150; 248/241; 248/240.2; 312/313

[58] Field of Search ..... 312/310, 313, 312/314, 408; 108/132; 211/149, 150; 248/241, 240.2

[56] References Cited

U.S. PATENT DOCUMENTS

| | | | |
|---|---|---|---|
| 2,035,226 | 3/1936 | Forsthoefel | 312/310 |
| 2,757,061 | 7/1956 | Anderson | 312/313 |
| 2,767,042 | 10/1956 | Kesling | 312/313 |
| 2,955,892 | 10/1960 | Pulaski et al. | 211/150 X |
| 3,151,576 | 10/1964 | Patterson | 211/150 |
| 3,167,186 | 1/1965 | Squire | 211/150 |
| 4,123,130 | 10/1978 | Locke | 312/285 |
| 4,492,169 | 1/1985 | Ware et al. | 211/150 X |
| 5,277,488 | 1/1994 | Cleary et al. | 312/408 |

*Primary Examiner*—Peter M. Cuomo
*Assistant Examiner*—Stephen Vu
*Attorney, Agent, or Firm*—Beveridge, DeGrandi, Weilacher & Young, LLP

[57] ABSTRACT

A refrigerator having a swing shelf swings the shelf according to the dimensions and quantity of stored items accommodated within a cooling chamber to employ the swing shelf in the stretched or erected state. The swing shelf is shaped as an alphabet "T" for swinging about a portion of crossing a horizontal plate and a vertical plate. The swinging position is classified into the stretched state and erected state, and support rods and slot parts separable from the side walls of the cooling chamber are installed for settling respective states. When the swing shelf is in the erected state, the horizontal plate is provided to the vertically-raised place to simply and conveniently accommodate the large-sized stored item regardless of the dimensions thereof.

8 Claims, 4 Drawing Sheets

REFRIGERATOR HAVING A SWING SHELF

BACKGROUND OF THE INVENTION

1. Field of the Invention

The present invention relates to a refrigerator having a swing shelf, and more particularly to a refrigerator having a swing shelf, wherein the swing shelf is employed by swinging in advance according to the dimensions and quantity of stored items for effectively utilizing the internal space of the refrigerator.

2. Description of the Prior Art

FIG. 1 illustrates a perspective view showing a conventional refrigerator having shelves. As shown in FIG. 1, a plurality of flat-type shelves 14 are transversely installed to a cooling chamber 10 of the refrigerator for accommodating stored items such as foods. Shelves 14 are settled by being put over beads 12 projecting from the side walls of cooling chamber 10.

Thus, a user adjusts the top and bottom interval of shelves 14 for securing an efficient accommodating space within cooling chamber 10. In more detail, shelves 14 are arranged in such a manner that the plurality of shelves are widely distanced from each other for a tall stored item or closely spaced from each other for a short stored item.

According to the conventional refrigerator having the above-stated shelves, a considerable space capable of accommodating the stored items is secured for stably retaining a large quantity of stored items. However, the dimensions of the stored items are restricted due to multilayered flat-type shelves 14. Therefore, the refrigerator is inconvenient in that a proper number of shelves must be taken out to be eliminated for storing a large-sized stored item. Consequently, the accommodating procedure of the stored items is laborious and troublesome, and the space within cooling chamber 10 cannot be efficiently utilized.

U.S. Pat. Nos. 4,123,130 and 5,277,488 disclose shelves of refrigerators similar to the above-described one.

SUMMARY OF THE INVENTION

The present invention is devised to solve the foregoing problems. It is an object of the present invention to provide a refrigerator having a swing shelf, wherein the shelf swings for being used in a stretched or erected state in accordance with the dimensions and quantity of stored items accommodated into a cooling chamber.

To achieve the above object of the present invention, a refrigerator having a swing shelf includes the swing shelf which has a horizontal plate transversely installed within a cooling chamber for retaining stored items thereon and a vertical plate perpendicularly projecting from the central portion of the horizontal plate. Here, both ends of the horizontal plate are supported by a shelf support unit separably joined to the inside of the cooling chamber, and a guiding unit guides the clockwise/counterclockwise swing motion of the swing shelf in view of a front side of the cooling chamber.

Preferably, a length of the vertical plate is as long as approximately half the length of the horizontal plate, and the horizontal plate and vertical plate mutually make a right angle with each other.

It is preferable that the shelf support unit includes a pair of slot parts formed in the inner wall of the cooling chamber, and a support rod having both ends fitted into the pair of slot parts. Insertion balls having diameters larger than the diameter of the support rod may be formed to both ends of the support rod.

It is further preferable that an interior of the slot part is wider the an opening thereof, and the guiding unit has a swing shaft extendedly projecting from the swing shelf in a direction of a swing axis. The swing shaft is fitted into a swing supporting body for supporting the swing shaft, and a fixture fixes the swing supporting body to the rear wall of the cooling chamber.

Alternatively, the object of the present invention is achieved by a refrigerator having a swing shelf, which includes the swing shelf having a horizontal plate transversely installed within a cooling chamber for retaining stored items thereon and a vertical plate perpendicularly provided from the central portion of the horizontal plate by projecting as much as half the length of the horizontal plate. Then, a pair of slot parts respectively having an interior wider than an opening are formed into one side of the swing shelf in the inner wall of the cooling chamber, and a support rod has both ends fitted into the pair of slot parts. In addition to these, insertion balls formed to both ends of the support rod have diameters larger than the diameter of the support rod, and a swing shaft extendedly projects from the swing shelf in the swing shaft line direction. The swing shaft is fitted into a swing supporting body for supporting the swing shaft, and a fixture fixes the swing supporting body to the rear wall of the cooling chamber.

When a user intends to accommodate a normally-high stored item in the refrigerator having the swing shelf according to the present invention as described above, the swing shelf is settled in the stretched state. Whereas, when a tall stored item is intended to be vertically accommodated, the swing shelf is settled in the erected state.

Consequently, the refrigerator having the swing shelf according to the present invention constructed as above is not restricted by the dimensions of the stored item accommodated into the cooling chamber, thereby easily and simply retaining the large-sized stored item therein. Furthermore, the wasteful space resulting from the accommodating of the large-sized stored item is minimized to efficiently utilize the internal space of the cooling chamber.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A refrigerator having a swing shelf according to the present invention will be described in detail with reference to accompanying drawings.

Figure 1:
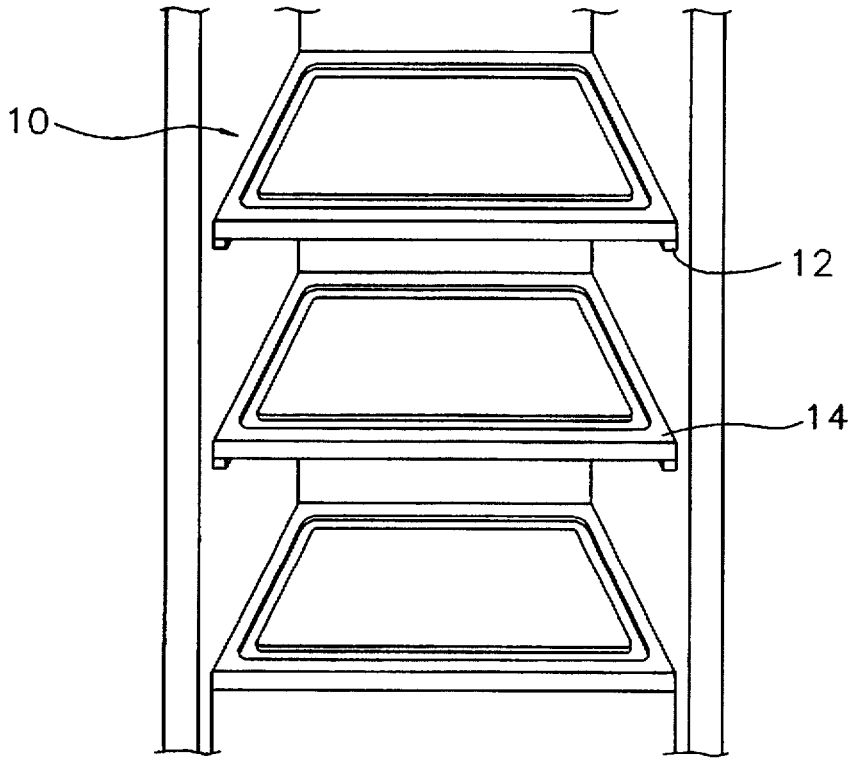
FIG. 1 PRIOR ART
FIG. 1 is a perspective view showing a conventional refrigerator having shelves.
Figure 2:
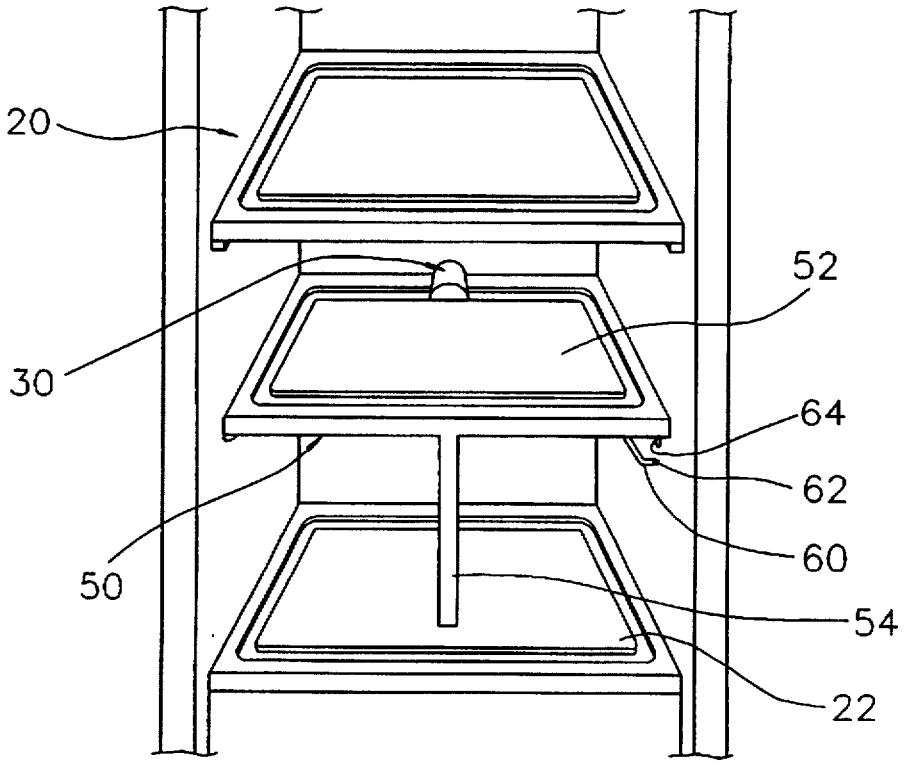
FIG. 2 is a perspective view showing a case that a swing shelf of a refrigerator according to the present invention is in a stretched state.

FIG. 2 is a perspective view showing a case that the refrigerator having the swing shelf according to the present invention has a stretched shelf. Referring to FIG. 2, swing shelf 50 is installed to the interior of a cooling chamber 20 in addition to flat-type shelves 22.

Swing shelf 50 is shaped as an alphabet "T" when being stretched. In order words, swing shelf 50 includes a horizontal plate 52 capable of retaining stored items thereon and a vertical plate 54 perpendicularly projecting from the central portion of bottom plane of horizontal plate 52 in the straightly downward direction thereof. The projecting length of vertical plate 54 is approximately half the length of horizontal plate 52, which contacts flat-type shelf 22 for dispersing a load of the stored items retained onto horizontal plate 52. A swing supporting body 30 for supporting the swinging motion of swing shelf 50 is installed to a rear wall 24 of cooling chamber 20 where horizontal plate 52 crosses with vertical plate 54, and horizontal plate 52 is partly cut away as much as the size of swing supporting body 30.

Both sides of horizontal plate 52 of swing shelf 50 in the stretched state are settled by support rods 60. Insertion balls 62 are formed to both ends of support rod 60, so that support rod 60 is inserted to be fixed to slot parts 64 formed in the side wall by means of insertion balls 62. Then, the other portion of support rod 60 supports horizontal plate 52.

Figure 3:
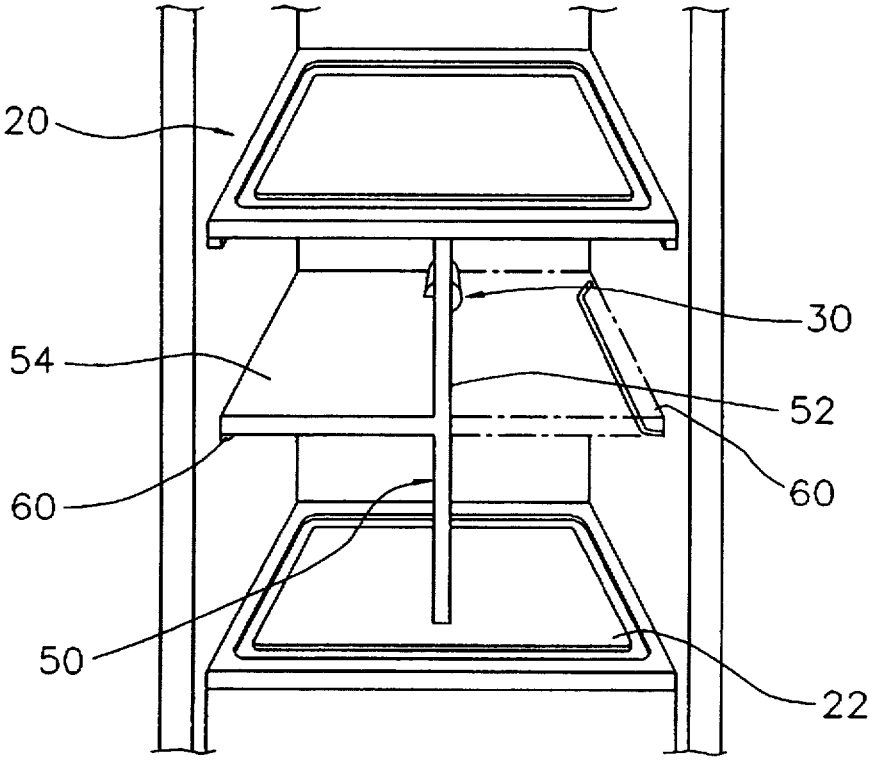
FIG. 3 is a perspective view of a case that the swing shelf shown in FIG. 2 is in an erected state.

FIG. 3 is a perspective view of a case that swing shelf 50 shown in FIG. 2 is in an erected state. As shown in FIG. 3, T-shaped swing shelf 50 is rotated clockwise roughly by as many as 90° such that horizontal plate 52 attains the vertical state to disperse the load of the stored item, and vertical plate 54 attains the horizontal state to retain the stored item thereon.

Both ends of horizontal plate 52 are supported by contacting flat-type shelf 22. Also, the peripheral end of vertical plate 54 is supported by support rod 60, and support rod 60 in the opposite side may be separated from cooling chamber 20 to be preserved apart, as required. A dotted portion of FIG. 3 is provided for comparing the stretched state and erected state of swing shelf 50.

Figure 4:
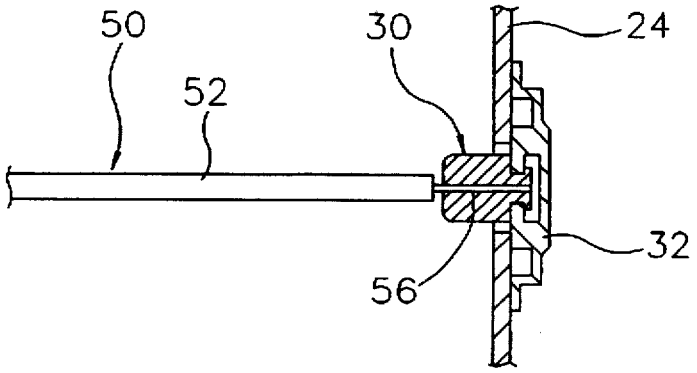
FIG. 4 is an enlarged sectional view showing the swing supporting body of FIG. 2.

FIG. 4 illustrates an enlarged section view of swing supporting body 30 shown in FIG. 2. Referring to FIG. 4, a swing shaft 56 protruding in the swing shaft line direction is installed to swing shelf 50 where horizontal plate 52 intersects vertical plate 54. Swing shaft 56 is long enough to penetrate into rear wall 24 by a predetermined depth.

Swing supporting body 30 is perforated in the center thereof for being rotated while being fitted with swing shaft 56. Swing supporting body 30 is fitted into rear wall 24, and firmly fixed by means of a fixture 32 installed to the back side of rear wall 24.

Figure 5:
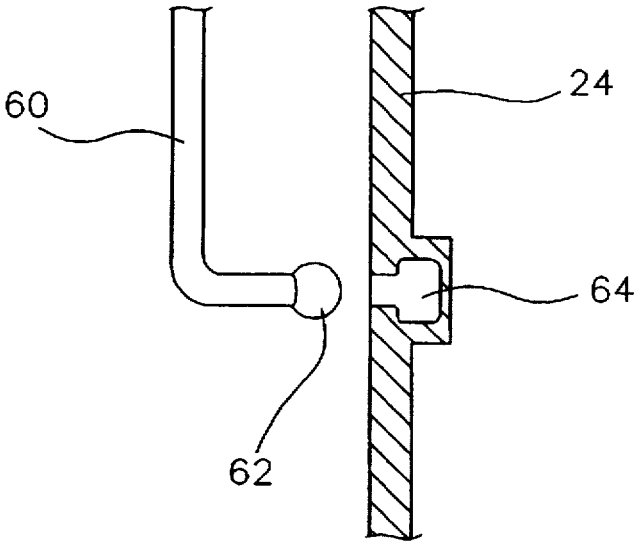
FIG. 5 is an enlarged sectional view showing the support rod and slot part of FIG. 2.

FIG. 5 is an enlarged sectional view showing support rod 60 and slot part 64. As shown in FIG. 5, support rod 60 is shaped as a rod having a circular section, and formed with spherical insertion balls 62 having a larger diameter than the circular section at both ends thereof. Since rear wall 24 is formed with slot part 64 having an interior wider than an entrance thereof, swing shelf 50 does not come out toward the load supporting direction when being fitted into insertion balls 62.

When swing shelf 50 is intended to be stretched in the refrigerator having the swing shelf according to the present invention described as above, support rod 60 is separated and swing shelf 50 swings centering about swing supporting body 30 to have the "T" shape. Then, support rods 60 are fixedly inserted to slot parts 64 at both ends of horizontal plate 52. At this time, the stored items are retained on the upper plane of horizontal plate 52.

When swing shelf 50 is intended to be erected, pair of support rods 60 are separately removed from slot parts 64. Then, swing shelf 50 swings clockwise centering about swing supporting body 30 by as many as 90°. After this, support rod 60 is fitted into slot part 64 toward which vertical plate 54 faces, thereby being fixed thereto. At this time, the stored item is retained on the upper plane and the lower space of vertical plate 54, and a tall stored item can be retained onto the big accommodating space provided to the right of horizontal plate 52.

As required, swing shelf 50 swings counter-clockwise centering about swing supporting body 30 by as many as 90° and support rod 60 is then fixed in the manner the same as the above-described method.

As a result, in the refrigerator having the swing shelf according to the present invention, the maximum dimensions of the stored item capable of being accommodated within the cooling chamber becomes increased to simply and conveniently accommodate the large-sized stored item. Also, when the large-sized stored item is accommodated, the remaining space can be efficiently utilized in retaining the stored items over the conventional technique.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A refrigerator having a swing shelf comprising:

said swing shelf having a horizontal plate transversely installed within a cooling chamber for retaining stored items thereon and a vertical plate perpendicularly projected from the central portion of said horizontal plate;

shelf support means separably joined to the inside of said cooling chamber for supporting said swing shelf; and guiding means for guiding the clockwise/counterclockwise swing motion of said swing shelf in view of a front side of the cooling chamber.

2. The refrigerator having a swing shelf as claimed in claim 1, wherein a length of said vertical plate is as long as approximately half the length of said horizontal plate.

3. The refrigerator having a swing shelf as claimed in claim 2, wherein said horizontal plate and vertical plate mutually make a right angle with each other.

4. The refrigerator having a swing shelf as claimed in claim 1, wherein said shelf support means comprises:

a pair of slot parts formed in the inner wall of said cooling chamber; and a support rod having both ends fitted into said pair of slot parts.

5. The refrigerator having a swing shelf as claimed in claim 4, wherein insertion balls having diameters larger than the diameter of said support rod are formed to both ends of said support rod.

6. The refrigerator having a swing shelf as claimed in claim 5, wherein an interior of said slot part is wider than an opening thereof.

7. The refrigerator having a swing shelf as claimed in claim 1, wherein said guiding means comprises:

a swing shaft extendedly projecting from said swing shelf in a direction of a swing axis;

a swing supporting body fitted with said swing shaft for supporting said swing shaft; and a fixture for fixing said swing supporting body to the rear wall of said cooling chamber.

8. The refrigerator having a swing shelf comprising:

said swing shelf having a horizontal plate transversely installed within a cooling chamber for retaining stored items thereon and a vertical plate perpendicularly provided from the central portion of said horizontal plate by projecting as much as half the length of said horizontal plate;

a pair of slot parts formed in the inner wall of said cooling chamber and having an interior wider than an opening thereof;

a support rod having both ends fitted into said pair of slot parts;

insertion balls formed to both ends of said support rod having diameters larger than the diameter of said support rod;

a swing shaft extendedly projecting from said swing shelf in a direction of a swing axis;

a swing supporting body fitted with said swing shaft for supporting said swing shaft; and a fixture for fixing said swing supporting body to the rear wall of said cooling chamber.

* * * * *